US006025308A

United States Patent [19]

Matsuya et al.

[11] Patent Number: 6,025,308

[45] Date of Patent: Feb. 15, 2000

[54] AMINE-FUNCTIONALIZED POLYMERS

[75] Inventors: Hidehiko Matsuya, Kyoto, Japan; Thomas J. Karol, Norwalk, Conn.

[73] Assignee: R. T. Vanderbilt Company, Inc., Norwalk, Conn.

[21] Appl. No.: 09/151,362

[22] Filed: Sep. 10, 1998

[51] Int. Cl.[7] ..... C10M 145/14; C10M 145/16

[52] U.S. Cl. ..... 508/235; 508/468; 508/471; 508/551; 525/327.6; 525/382

[58] Field of Search ..... 508/232, 470, 508/471, 447, 466, 468, 551, 235; 525/327.6, 382

[56] References Cited

U.S. PATENT DOCUMENTS

| | | | |
|---|---|---|---|
| 2,580,053 | 12/1951 | Tutwiler et al. | 508/468 |
| 2,642,414 | 6/1953 | Bauer et al. | 508/468 |
| 2,698,316 | 12/1954 | Giammaria | 508/235 |
| 3,048,487 | 8/1962 | Minsk | 430/518 |
| 4,668,412 | 5/1987 | Hart et al. | 508/235 |
| 4,699,723 | 10/1987 | Kapuscinski et al. | 508/271 |
| 4,767,553 | 8/1988 | Hart et al. | 508/235 |
| 5,055,213 | 10/1991 | Germanaud et al. | 508/235 |
| 5,585,337 | 12/1996 | Day et al. | 508/466 |

*Primary Examiner*—D. Gabrielle Brouillette
*Assistant Examiner*—Cephia D. Toomer
*Attorney, Agent, or Firm*—Baker & Botts, LLP

[57] ABSTRACT

A method is disclosed for preparation of amine functionalized copolymers by reacting copolymers of alkyl methacrylate and maleic anhydride with N-phenyl-1,4-phenylenediamine in mineral oil and inert atmosphere at 40 to 75° C. The copolymers are useful viscosity index improvers when incorporated into lubricating oils.

8 Claims, No Drawings

AMINE-FUNCTIONALIZED POLYMERS

BACKGROUND OF THE INVENTION

The present invention relates to functionalized polymers. More particularly, it concerns a method of preparation of functionalized polymers which impart improved properties to lubricating oil compositions.

Lubricating compositions ordinarily are formulated with various additives to enhance their performance. Some additives have low solubility in oil or their solubility may decrease when combined with other additives. Additives that have poor oil solubility are incorporated into lubricating oil compositions with the aid of dispersants, viscosity index improvers, or pour point dispersants.

Prior art dispersants include copolymers of acrylic ester and dicarboxylic acid functionalized with a Mannich base and a primary or secondary amine as described in U.S. Pat. No. 4,668,412.

Polymers functionalized with an amine alone by prior art methods often yield dark colored products. When incorporated into lubricating oil, the amine-functionalized polymers cause turbidity and formation of a precipitate. These undesirable effects are caused by residual amine remaining in the product.

Surprisingly, it has been discovered that polymers can be functionalized with an amine in the absence of a Mannich base to yield light colored products that are oil-soluble and have good dispersability, oxidation stability and viscosity improving properties.

SUMMARY OF THE INVENTION

In accordance with the invention, there is provided a method for preparation of amine-functionalized polymers by reacting a copolymer (A) containing monomer units of at least one alkyl methacrylate having not more than 9 carbon atoms in the alkyl group and monomer units of maleic anhydride with N-phenyl-1,4-phenylenediamine in the presence of a catalyst, in oil media and in inert atmosphere at 40 to 75° C. and vacuuming off unreacted material.

Another aspect of the invention concerns improved lubricating compositions comprising a major amount of base oil and a minor viscosity improving amount of amine-functionalized copolymer prepared by the method described above by reacting a copolymer A containing monomer units of at least one alkyl methacrylate having not more than 9 carbon atoms in the alkyl group and monomer units of maleic anhydride with N-phenyl-1,4-phenylenediamine, the copolymer A being essentially free of residual maleic anhydride.

DESCRIPTION OF SPECIFIC EMBODIMENTS

The polymers which may be employed in the practice of the invention are oil-soluble, substantially linear, carbon-carbon backbone polymers. The polymers contain first units derived from alkyl methacrylate having the formula

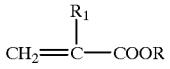

wherein $R^1$ is hydrogen, alkyl, aralkyl, cycloalkyl, aryl and alkaryl. R is an alkyl group containing not more than 9 carbon atoms. It is preferred that the first units are derived from two different alkyl methacrylates. Preferably, the first units are derived from one subgroup of alkyl methacrylates containing 1 to 4 carbons in the alkyl group and another subgroup of alkyl methacrylates containing 5 to 9 carbon groups in the alkyl group, the molar ratio of the lower alkyl subgroup to the higher alkyl subgroup ranging from 5:95 to 30:70.

The copolymer of the invention may contain about 60 to 99.5 weight percent of the first unit monomers and preferably about 70 to 99.5 weight percent of the first unit monomers. The amount is based on the viscosity index improving functionality.

The second unit of the copolymer is derived from a maleic anhydride. The amount is generally 0.1 to 5.0 weight percent and preferably 0.5 to 3.0 weight percent. The amount is based on the antioxidant, dispersibility and oil solubility properties of the viscosity index improver when formulated in lubricating base oil.

The copolymer of alkyl methacrylates and maleic anhydride may contain other polymerizable monomers. The monomers may be aliphatic hydrocarbons with 10 to 30 carbons; polycarboxylic acid esters such as alkyl acrylates, alkyl crotonates, dialkyl maleates, dialkyl fumarates, dialkyl itaconates; vinyl derivatives of aromatic compounds such as styrene and vinyl toluene and vinyl esters such as vinyl acetate, vinyl propionate and the like.

The average molecular weight of the copolymers ranges from about 10,000 to 500,000 and preferably from 20,000 to 300,000.

The copolymer is reacted with an aryldiamine to produce an amine-functionalized polymer of the invention. A preferred amine is N-phenyl-1,4-phenylenediamine. The amine may be substituted by alkyl groups on the phenyl ring. The reaction is conducted in oil media. A preferred oil is mineral oil, paraffinic oil, solvent refined paraffinic oil and isomerized paraffinic oil from hydrocracking paraffins. Particularly preferred is high viscosity oil such as 50 to 300 viscosity neutral oil.

The reaction is further conducted under inert gas and at the reaction temperature of about 40 to 150° C.

Catalysts useful for the reaction are azo compounds and peroxides. Examplary azo compounds, among others, are 2,2'-azobis (2,4-valeronitrile), 2,2'-azobis (4-methoxy-2,4-valeronitrile), 2,2'-azobis (2-methylnitrile), 1,1'-azobis (cyclohexyl-1-carbonylnitrile) and the like.

Representative peroxides, among others, are isobutyl peroxide, di-n-propyl peroxide, free radical generating dicarbonate such as bis (4-t-butylcyclohexylperoxydicarbonate, benzoyl peroxide, t-butylperoxy isobutylate, t-butylperoxybenzoate, dicumyl peroxide and the like. Particulary preferred are 2,2'-azobis (2,4-dimethylvaleronitrile) and benzoyl peroxide.

The catalyst is used in the amount of 0.1 to 5 percent.

For polymerization, alkyl methacrylate, maleic anhydride and, if desired, other polymerizable monomers are either admixed or added separately to the mineral oil reaction media together with the polymerization catalyst.

In the past, the reaction of a long chain copolymer of alkyl methacrylate and maleic anhydride with N-phenyl-1,4-phenylenediamine caused undesirable dark discoloration and a turbidity problem. The problems are due to the formation of low molecular weight amides or imides from the reaction of residual maleic anhydride remaining after the formation of the copolymer and the subsequently added N-phenyl-1,4-phenylenediamine. The amide or imide impurities are insoluble in mineral oil and thus cause a turbidity problem. Furthermore, in the reaction between the copolymer and N-phenyl-1,4-phenylenediamine, the long chain group of alkyl methacrylate forms a stearic hindrance that prevents the maleic anhydride unit of the copolymer to react with N-phenyl-1,4-phenylenediamine at the normal reaction temperature range of 80 to 200° C. In this temperature range both the unreacted portion of N-phenyl-1,4-phenylenediamine and the reacted portion of N-phenyl-1,4-phenylenediamine bonded to the copolymer becomes discolored under thermal oxidation conditions.

The turbidity problem is solved by reducing below 0.1 weight percent the amount of unreacted maleic anhydride in the copolymer. Then the final product used as viscosity index improver causes no turbidity problem. Therefore, the reaction of maleic anhydride in the copolymer should be above 95 percent and preferably above 98 percent. The reaction is controlled by adjusting the polymerization time, amount of catalyst used and applying vacuum after the reaction to reduce the residual maleic anhydride content.

The advantage of the reaction of the invention is the reduction of discoloration of the amine functionalized copolymer. The discoloration is reduced by carrying out the reaction of the copolymer and N-phenyl-1,4-phenylenediamine in a mineral oil under inert gas atmosphere at 40 to 75° C. The amount of mineral oil may range from 10 to 70 weight percent and serves to reduce the viscosity of the reaction.

The reduction of steric hinderance of the alkyl group of the alkyl methacrylate units in the copolymer necessitates the low reaction temperature ranging from about 40 to 75° C. For this purpose, the carbon number in the alkyl group of the methacrylate is less than 9. Preferred are mixed methacrylates having 1 to 4 carbons md 5 to 9 carbons in the alkyl group. When the carbon number exceeds 9, the reaction at the temperature range of 40 to 75° C. becomes very sluggish.

If the reaction temperature exceeds 75° C. residual unreacted N-phenyl-1,4-phenylenediamine and the reacted N-phenyl-1,4-phenylenediamine in the copolymer will become subject to thermal oxidation resulting in dark discoloration. If the reaction temperature is below 40° C. the reaction proceeds very slowly.

The reaction is conducted in inert gas atmosphere including nitrogen and argon gases. The oxygen content in the inert gas phase is expected to be reduced below 100 ppm during the reaction under the inert gas atmosphere. An effective method is to bubble the inert gas into the reaction fluid at a rate of 10 to 1000 ml/min./liter, preferably 50 to 200 ml/min./liter of the reaction fluid.

Under these reaction conditions, a viscosity index improver is produced that has low discoloration and is free of turbidity.

The viscosity index improver of the invention is useful for lubricating base oils having a viscosity ranging from 50 neutral oil to 300 neutral oil (SUS). The base oils can be mineral oils and synthetic lubricating oils. Synthetic oils among others, include hydrocarbon systems of dodecene oligomers, trimethylol propane, pentaerythritol, hexamethylenediol, fatty acid, fatty acid alcohols or dimer acids such as adipic acid. Particularly preferred are petroleum process oils obtained by the so called Mobil Oil Dewaxing Process using synthetic zeolite as catalyst. These oils are MLDW type oils.

In general, the viscosity index improver is added to lubricating base oil in the amount of 0.5 to 30 weight percent based on the amount of the oil.

For engine oils, the preferred amount is about 0.5 to 10 weight percent. In the case of gear oils and auto-transmission oils, the preferred amount is 2 to 25 weight percent.

The lubricating oil formulations may contain other known additives. Such additives include antiwear agents, extreme pressure additives, friction reducers, antioxidants, corrosion inhibitors, pour point depressants, cleansing agents and dispersing agents. The lubricants may contain other known viscosity index improvers, as for example, ethylene-propylene copolymer and hydrogenated styrene-isoprene copolymer additive. Nitrogen-containing olefin type viscosity index improvers possess cleaning and dispersing properties as for example nitrogen-containing poly (methacrylate) type viscosity improvers.

The application of the improved lubricating oils, among others, include gasoline engine oils, diesel engine oils, gear oils, auto-transmission oils, motor oils, tractor oil, power steering oils, shock absorber oils, and compression oils.

The following examples are given for the purpose of further illustrating the invention. All percentages and parts are based on weight unless otherwise indicated.

EXAMPLE 1

A two-liter flask was fitted with a condenser and agitator and charged with 170 g No. 100 neutral mineral oil. Nitrogen gas was allowed to flow through the flask to replace atmospheric air inside the flask. The flask was heated to 70° C. under nitrogen. Methyl methacrylate 40 g; 2-ethylhexyl methacrylate, 320 g; styrene, 40 g, maleic anhydride, 4 g; and catalyst, azobis (valeronitrile) 0.8 g were mixed together. The mixture was added dropwise to the flask within 4 hours and allowed to copolymerize at 70° C. for 3 hours. Then 230 g of mineral oil was added to the flask and the temperature was raised to 130° C. under 10 mm Hg to remove unreacted reactants.

The copolymer product was obtained in mineral oil. The NMR spectra showed 0.08% maleic anhydride; the GPC showed an average m.w. of 280,000 and m.w. distribution (Mw/Mn) was 1.9.

The copolymer product was cooled to 40° C. and N-phenyl-1,4-phenylenediamine, 7 g was added to the flask. Nitrogen gas was allowed to bubble through at 100 ml/min. to reduce oxygen content in the gas phase. The temperature was again raised to 60° C. and the reaction allowed to copolymerize for 4 hours. The final product was the N-phenyl-1,4-phenylenediamine functionalized polymer having viscosity index improving properties. At the completion of the reaction, the IR Spectrum indicated that a peak at 1780 $cm^{-1}$ (maleic anhydride) had disappeared from the product. The ASTM color was 2.0 as determined by ASTM method JIS K258 0-1980.

EXAMPLE 2

The reaction described in Example 1 was repeated except the base copolymer was prepared by mixing together methyl methacrylate 40 g; butyl methacrylate 40 g; styrene, 40 g;

maleic anhydride, 4 g and azobis(valeronitrile) 0.8 g and adding dropwise to mineral oil, 170 g. The produced copolymer had an average m.w. of 290,000 and a molecular distribution of 1.9.

The NMR spectra showed 0.07% maleic anhydride. The copolymer was copolymerized with N-phenyl-1,4-phenylenediamine, 7 g, as described in Example 1. At the completion of the reaction, the IR spectra indicated that a peak at 1780 $cm^{-1}$ had disappeared. The final product was a yellow clear viscous liquid with ASTM color of 2.0 as determined by the method JIS K258 0-1980.

EXAMPLE 3

The reaction described in Example 1 was repeated except for the preparation of the base copolymer 8 g of maleic anhydride was used. The obtained copolymer had an average m.w. of 240,000 and a molecular distribution of 1.8. The free maleic anhydride content was 0.09%. The copolymer was reacted with 14 g of N-phenyl-1,4-phenylenediamine as described in Example 1. At the completion of the reaction, the IR spectra indicated that a peak at 1780 $cm^{-1}$ had disappeared. The final product was a clear yellow liquid with ASTM color of 3.0 as determined by the method JIS K-158 0-1980.

COMPARATIVE EXAMPLE A

The reaction described in Example 1 was repeated with higher alkyl methacrylates. The base copolymer was prepared from methyl methacrylate, 60 g; mixed dodecyl methacrylate and tridecyl methacrylate, 300 g; tetradecyl methacrylate, 40 g; and maleic anhydride, 40 g. The mixture was added to mineral oil, 170 g. The produced copolymer had an average m.w. of 240,000 and a molecular distribution of 1.0. The NMR spectra showed 0.2% maleic anhydride. The copolymer was copolymerized with N-phenyl-1,4-pheylendiamine, 7 g at 60° C. At the 1780 $cm^{-1}$ of the reaction, the IR spectra indicated that a peak at 1780 $cm^{-1}$ appears from the maleic anhydride group in the polymer molecule. The final product was a yellow cloudy, viscous liquid with ASTM color of 5.0 as determined by the method JIS K 258 0-1980.

COMPARATIVE EXAMPLE B

The reaction described in Example 1 was repeated without using mineral oil reaction media. The N-phenyl-1,4-phenylenediamine, 7 g, was added to the copolymer at 160° C. The reaction was about 50% incomplete and produced a black cloudy viscous liquid with ASTM color of 8.0 as determined by the JIS K 2580-1980 method.

COMPARATIVE EXAMPLE C

The reaction described in Example 1 was repeated except 40 g of methyl methacrylate was used and the reactant mixture was added dropwise to 230 g mineral oil. The copolymer had a m.w. of 250,000 and a molecular distribution of 1.8. The base copolymer was reacted with N-phenyl-1,4-phenylene diamine, 7 g to produce a cloudy liquid.

EXAMPLE 4

The viscosity index improvers of the invention and the comparative products described above were added to SG grade gasoline engine oil. The formulation, so-called DI package contained a blend of 100 neutral solvent refined oils used for formulating engine lubricating oils. The concentration of the viscosity index improver in the DI package was 5 weight percent and the range about 4 to 5 weight percent. The kinematic viscosity at 100° C. was 10.2 $mm^2/S$ which is equivalent to CCS viscosity of 3,000 mPa.s at 25° C. The product appearance and oxygen stability tests were carried out and the results are compiled in Table I and II. Appearance was determined by visual observation at 25° C. The oxygen number was determined at 165.5° C. after 96 hours by the JIS K 2514 method.

TABLE I

| Viscosity Index Improver | Appearance at 25° C. |
|---|---|
| Example 1 | Amber, clear, no precipitate |
| Example 2 | Amber, clear, no precipitate |

TABLE I-continued

| Viscosity Index Improver | Appearance at 25° C. |
|---|---|
| Example 3 | Amber, clear, no precipitate |
| Comparative ex. A | Amber, clear, some precipitate |
| Comparative ex. B | Black turbid liquid |
| Comparative ex. C | Amber clear liquid, no precipitate |

TABLE II

| Oxygen Stability Test | | |
|---|---|---|
| Viscosity Index Improver | Oxygen No. | Sludge, Percent |
| Example 1 | 0.8 | 0.5 |
| Example 2 | 0.7 | 0.4 |
| Example 3 | 0.3 | 0.2 |
| Comparative ex. A | 1.8 | 1.3 |
| Comparative ex. B | 0.8 | 0.8 |
| Comparative ex. C | 3.0 | 2.5 |

The above examples and comparative examples demonstrate that the viscosity index improvers of the invention have improved characteristics. The viscosity improvers of the invention exhibit little discoloration, show clarity, good oxygen stability and good sludge dispersibility.

The above embodiments have shown various aspects of the present invention. Other variations will be evident to those skilled in the art and such modifications are intended to be within the scope of the invention as defined by the appended claims.

What is claimed is:

1. A method for preparing a viscosity index improver which comprises reacting N-phenyl-1,4-phenylenediamine with a copolymer (A) containing monomer units of at least one alkyl methacrylate (a1) containing not more than 9 carbon atoms in the alkyl group and monomer units of maleic anhydride (a2), at a temperature of 40–75° C., in the presence of a mineral oil and within an atmosphere of an inert gas.

2. The method of claim 1, wherein the content of (a1) in (A) is 60–99.9% by weight.

3. The method of claim 1, wherein the content of (a2) in (A) is 0.1–5% by weight.

4. The method of claim 1, wherein said (a1) comprises an alkyl methacrylate (a1-1) containing 1–4 carbon atoms in the alkyl group and an alkyl methacrylate (a1-2) containing 5–9 carbon atoms in the alkyl group and the ratio of (a1-1) and (a1-2) is from 5:95 to 30:70 by weight.

5. The method of claim 1, wherein the content of unreacted maleic anhydride in copolymer (A) is not more than 0.1% by weight.

6. The method of claim 1, wherein the inert gas is introduced into the reaction mixture.

7. A lubricating oil composition comprising a major amount of base oil and a minor viscosity improving amount of amine-functionalized copolymer prepared by reacting a copolymer (A) containing monomer units of at least one alkyl methacrylate (a1) containing not more than 9 carbon atoms in the alkyl group and monomer units of maleic anhydride (a2), provided that the copolymer contains less than 0.1 percent unreacted maleic anhydride, with N-phenyl-1,4-phenylenediamine at a temperature of 40 to 75° C. in the presence of a mineral oil and in inert atmosphere.

8. The lubricating oil composition according to claim 7 wherein said (a1) comprises an alkyl methacrylate (a1-1) containing 1–4 carbon atoms in the alkyl group and an alkyl methacrylate (a1-2) containing 5–9 carbon atoms in the alkyl group and the ratio of (a1-1) and (a1-2) is from 5:95 to 30:70 by weight.

* * * * *

UNITED STATES PATENT AND TRADEMARK OFFICE

CERTIFICATE OF CORRECTION

PATENT NO. : 6,025,308

DATED : February 15, 2000

INVENTOR(S) : Matsuya et al.

It is certified that error appears in the above-identified patent and that said Letters Patent is hereby corrected as shown below:

Column 1, line 58 (formula): "$R_1$" should read -- $R^1$ --;

Column 2, line 40: "Examplary" should read -- Exemplary --;

Signed and Sealed this

Twenty-second Day of May, 2001

*Attest:*

Nicholas P. Godici

NICHOLAS P. GODICI

*Attesting Officer*

*Acting Director of the United States Patent and Trademark Office*